US009233778B2

(12) United States Patent
Prince et al.

(10) Patent No.: US 9,233,778 B2
(45) Date of Patent: Jan. 12, 2016

(54) STACKABLE TRAY FOR BAGS CONTAINING LIQUIDS, STACKED ARRANGEMENTS AND STACKING METHODS

(71) Applicant: Parmalat Canada Inc., Etobicoke (CA)

(72) Inventors: Sidney Scott Prince, Hamilton (CA); Lee Scott Hoover, Toronto (CA); Antonino Cugliari, Brampton (CA)

(73) Assignee: Parmalat Canada Inc., Etobicoke (CA)

( * ) Notice: Subject to any disclaimer, the term of this patent is extended or adjusted under 35 U.S.C. 154(b) by 0 days.

(21) Appl. No.: 14/136,032

(22) Filed: Dec. 20, 2013

(65) Prior Publication Data

US 2014/0197065 A1 Jul. 17, 2014

Related U.S. Application Data

(60) Provisional application No. 61/751,377, filed on Jan. 11, 2013, provisional application No. 61/787,937, filed on Mar. 15, 2013.

(51) Int. Cl.
*B65D 21/02* (2006.01)
*B65D 71/70* (2006.01)

(52) U.S. Cl.
CPC ..... *B65D 21/0213* (2013.01); *B65D 71/70* (2013.01)

(58) Field of Classification Search
CPC ..... B65D 21/00; B65D 21/0209; B65D 21/0212; B65D 21/041; B65D 21/043; B65D 21/04; B65D 21/048; B65D 21/0213; B65D 71/70
USPC ..... 206/427, 509, 511, 503, 519, 518; 220/519, 505, 23.6
See application file for complete search history.

(56) References Cited

U.S. PATENT DOCUMENTS 3,151,799 A 10/1964 Engles, Jr. et al.
3,229,814 A 1/1966 Cowman (Continued)

FOREIGN PATENT DOCUMENTS

DE 8108411 U1 9/1981
DE 9210033 U1 10/1992

(Continued)

OTHER PUBLICATIONS

Plascon, Rugged Stack/Nest Crates and Dollies, accessed Nov. 4, 2013 at http://www.plascongroup.com/rugged-stack-nest-crates-and-dollies.html.

(Continued)

*Primary Examiner* — Fenn Mathew
*Assistant Examiner* — Don M Anderson
(74) *Attorney, Agent, or Firm* — Wolf, Greenfield & Sacks, P.C.

(57) ABSTRACT

Stackable trays for bags containing liquids, stacked arrangements and stacking methods are disclosed. A tray has a first surface to support one or more bags containing liquid and could include a plurality of cells adapted to receive the bags. The tray has a second surface opposite the first surface. The second surface transfers at least a portion of a load on the first surface to one or more bags containing liquid arranged below the second surface. A stacked arrangement includes multiple layers of bags containing liquid with a respective stackable tray between adjacent layers of the multiple layers. The trays could thus be used in stacking or otherwise arranging bags containing liquid in multiple layers.

14 Claims, 10 Drawing Sheets

(56) References Cited

U.S. PATENT DOCUMENTS

| | | | | |
|---|---|---|---|---|
| 4,037,722 | A | 7/1977 | Bremer | |
| 4,101,049 | A | 7/1978 | Wallace et al. | |
| 4,360,231 | A | 11/1982 | Bolin | |
| 4,813,543 | A * | 3/1989 | Goldberg | 206/507 |
| 5,035,326 | A * | 7/1991 | Stahl | 206/507 |
| 5,520,010 | A | 5/1996 | Altman | |
| 5,645,169 | A | 7/1997 | Dull et al. | |
| 5,660,279 | A | 8/1997 | Apps | |
| 5,702,034 | A | 12/1997 | Semenenko | |
| 5,855,277 | A * | 1/1999 | Apps et al. | 206/510 |
| 6,290,057 | B1 | 9/2001 | Hurley | |
| D466,018 | S | 11/2002 | Apps | |
| D485,756 | S | 1/2004 | Apps | |
| 6,688,471 | B2 | 2/2004 | Stone et al. | |
| 6,966,442 | B2 | 11/2005 | Hassell et al. | |
| 7,128,234 | B2 | 10/2006 | Apps | |
| 7,464,817 | B2 | 12/2008 | Raghunathan et al. | |
| D594,660 | S | 6/2009 | Lindstrom | |
| D600,016 | S | 9/2009 | Tiilikainen | |
| D600,021 | S | 9/2009 | Lindstrom | |
| 7,689,481 | B2 | 3/2010 | Seagle et al. | |
| D632,960 | S | 2/2011 | Gilfert | |
| 8,109,216 | B2 | 2/2012 | Nono et al. | |
| 8,123,034 | B2 | 2/2012 | Apps et al. | |
| 8,146,746 | B2 | 4/2012 | Apps | |
| 8,146,771 | B1 | 4/2012 | Segeleon | |
| 8,448,806 | B2 | 5/2013 | Hassell | |
| 2005/0279651 | A1 | 12/2005 | Perret et al. | |
| 2006/0260971 | A1 | 11/2006 | Rivera et al. | |
| 2008/0217200 | A1 | 9/2008 | Eiten et al. | |
| 2008/0302691 | A1 | 12/2008 | Olson et al. | |
| 2009/0044732 | A1 | 2/2009 | MacKenzie | |
| 2009/0108002 | A1 | 4/2009 | Delbrouck | |
| 2009/0242568 | A1 | 10/2009 | Apps | |
| 2010/0044265 | A1 | 2/2010 | Ragsdale et al. | |
| 2010/0084297 | A1 | 4/2010 | Apps | |
| 2010/0206759 | A1 | 8/2010 | Eiten et al. | |
| 2011/0284411 | A1 | 11/2011 | Delbrouck et al. | |
| 2012/0241350 | A1 * | 9/2012 | Stahl | 206/509 |
| 2013/0026057 | A1 | 1/2013 | Shapiro | |

FOREIGN PATENT DOCUMENTS

| | | | |
|---|---|---|---|
| DE | 4425569 | A1 | 1/1996 |
| DE | 10204291 | A1 | 8/2003 |
| DE | 102005029304 | A1 | 1/2007 |
| EP | 1142796 | | 10/2001 |
| EP | 2000413 | A1 | 12/2008 |
| GB | 1097870 | | 1/1968 |
| WO | 2010055204 | A1 | 5/2010 |
| WO | 2011054700 | A1 | 5/2011 |

OTHER PUBLICATIONS

Examiner's Report dated Oct. 14, 2014 from corresponding Canadian Application No. 2,837,799.

Letter filed Jun. 19, 2015 with the Canadian Intellectual Property Office by a third party in respect of Canadian Patent Application No. 2,837,799.

Office Action dated Aug. 28, 2015 from corresponding Canadian Application No. 2,837,799.

* cited by examiner

STACKABLE TRAY FOR BAGS CONTAINING LIQUIDS, STACKED ARRANGEMENTS AND STACKING METHODS

CROSS-REFERENCE TO RELATED APPLICATION

This application claims the benefit of U.S. provisional patent application Ser. No. 61/751,377, filed on Jan. 11, 2013, and U.S. provisional patent application Ser. No. 61/787,937, filed on Mar. 15, 2013, the entire contents of which are hereby incorporated herein by reference.

FIELD OF THE INVENTION

Embodiments of the invention relate to stackable trays for bags typically containing liquids, such as milk, juice or water, and to stacked arrangements and stacking methods using such trays.

BACKGROUND OF THE INVENTION

Currently, beverages such as milk, juice and water and/or other liquids can be sold to consumers in plastic bags. In the present application, the term "milk bags" refers to plastic bags that hold milk for sale. Milk bags are typically filled with milk at a production location and then placed into crates for shipping to a retail or wholesale location for display and/or sale.

A representative example of a crate well known in the prior art is milk crate 100, which is plastic molded as illustrated in FIG. 1. Other milk crates of similar size and construction can be constructed of corrugated cardboard. Milk crates which hold milk bags 104 typically have a rigid frame, being square or rectangular in shape, and when such crates are stacked one crate sits on the upper edges of the side walls of the crate below. Thus, each side wall 102 supports a load from the crate(s) stacked above. It is possible to employ a collapsible crate instead, but these are not generally used because they can be labour intensive to employ. In general milk crates are not considered to be very pleasing from an esthetic point of view to consumers.

Another means of shipping, displaying and selling milk bags is shelving unit 200 illustrated in FIG. 2 which is typically constructed of metal. Shelving unit 200 consists of a frame 202 and one or more shelves 204 connected to the frame. The frame, generally, may include four vertical legs 206, which allow each shelf to be attached to the legs at each corner of the shelf. Wheels 208 can be connected to a bottom side of a bottom shelf to provide mobility. Milk bags can be placed on shelves 204 for display and sale to a consumer. Each metal shelf, except the lowest shelf, may be folded up so that a shelf underneath can be loaded. The shelves are kept in the up position by means of a pull pin. The pull pin can unintentionally slide out of its guide allowing the shelf to fall from the up position.

Depending on the volume of milk bags sold, retailers of milk bags may need to store and have on band multiple milk crates or shelving units for display to the customers in their stores. Prior art milk crates and shelving units can take up a lot of space which means that significant amount of valuable storage and display space can be taken up at a retailer. Furthermore, such prior art crates and shelves can also take up a lot of space when empty and not in use. Storage and transportation of empty milk crates and shelving units back to milk producers can also lead to an inefficient use of valuable space.

Rigid frame milk crates and shelving units also have the disadvantage of being less likely to be returned to milk producers for reuse. Rigid frame milk crates take up a lot of space when stacked. Milk bag shelving units can also lead to an inefficient use of space when transported back to a milk producer for reuse.

SUMMARY

This summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Some embodiments of the present disclosure may provide a stackable tray for stacking bags containing beverages, such as milk, juice or water in a space efficient manner.

In one embodiment, there is provided a stackable tray comprising: a first surface; and a second surface opposite the first surface, the second surface adapted to transfer at least a portion of a load on the first surface to one or more bags containing liquid arranged below the second surface.

In some embodiments, the first surface comprises a plurality of cells, each cell adapted to receive at least one bag containing liquid.

In some embodiments, the second surface is substantially flat opposite each of the plurality of cells.

In some embodiments, the first surface comprising one or more reinforcement ribs to strengthen the first surface.

In some embodiments, the first surface comprises cells of varying or substantially similar shape defined by the one or more reinforcement ribs.

In some embodiments, the cells comprise cells each shaped to receive three bags containing liquid.

In some embodiments, the two or more cells are each shaped to receive one bag containing liquid.

In some embodiments, the second surface comprising channels to strengthen the second surface.

In some embodiments, the stackable tray further comprises support columns extending upwards from the first surface.

In some embodiments, the support columns are arranged intersections of two or more reinforcement ribs formed on the first surface.

In some embodiments, each support column is adapted to receive a support column of another stackable tray when the stackable tray and the other stackable tray are in a nested configuration.

In some embodiments, the stackable tray further comprises at least one recessed pocket in the second surface, the at least one recessed pocket adapted to receive a support column of another stackable tray when the stackable tray and the other stackable tray are in a stacked configuration.

In some embodiments, the support column comprises a top and a base and is tapered, being narrower at the top than at the base.

In some embodiments, the at least one support column is releasably connected to the other stackable tray.

In some embodiments, the at least one support column is integral with a side wall extending along a periphery of the first surface.

In some embodiments, the first surface comprises two or more support columns of varying height, and the second surface comprises two or more recessed pockets of varying depth.

In one embodiment, there is provided a stacked arrangement comprising: multiple layers of bags containing liquid, each comprising a plurality of bags containing liquid; a respective stackable tray as described above, between adjacent layers of the multiple layers.

In one embodiment, there is provided a method comprising: providing a plurality of bags containing liquid; providing a plurality of stackable trays, each stackable tray comprising the stackable tray as described above; arranging the plurality of bags containing liquid in multiple layers, with a respective one of the plurality of stackable trays between adjacent layers of the multiple layers.

In one embodiment, there is provided a stacked arrangement comprising: a first surface; and a second surface opposite the first surface, the second surface adapted to transfer at least a portion of a load on the first surface to one or more bags containing liquid arranged below the second surface; one or more bags containing liquid on the first surface; and a plurality of bags containing liquid below the second surface.

In one embodiment, there is provided a method comprising: providing a stackable tray comprising: a first surface; and a second surface opposite the first surface, the second surface adapted to transfer at least a portion of a load on the first surface to one or more bags containing liquid arranged below the second surface; providing a plurality of bags containing liquid; and stacking the plurality of bags containing liquid in multiple layers using the stackable tray.

Other aspects and features of embodiments of the present disclosure will become apparent to those ordinarily skilled in the art upon review of the following description.

BRIEF DESCRIPTION OF THE DRAWINGS

In the following figures, dimensions of components are chosen for convenience and clarity only and are not necessarily shown to scale. Embodiments of the invention will now be described in greater detail with reference to the accompanying figures, in which.

DETAILED DESCRIPTION

Figure 1:
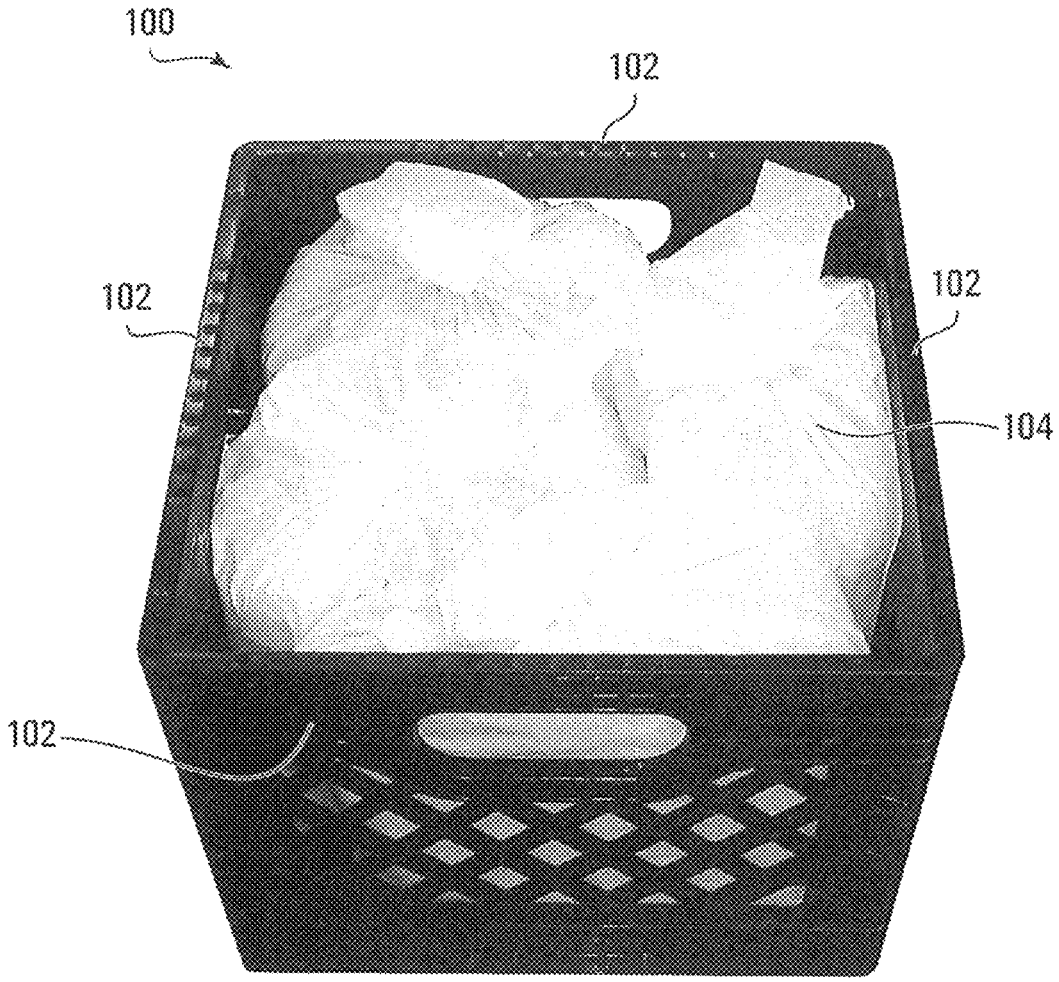
FIG. 1 Prior Art
FIG. 1 is a perspective view of a conventional milk crate.

Various embodiments illustrate a tray for stacking, transporting, displaying, and selling plastic bags filled with liquid. Though the following description makes frequent reference to "milk bags" in connection with one or more embodiments, it should be appreciated that embodiments could also or instead be used in association with stacking bags containing other beverages, such as juice or water, and/or other liquids.

FIGS. 3 to 10 show a first embodiment of a stackable tray for milk bags according to one embodiment. In some configurations, the tray is shown with milk bags and in some configurations the tray is shown without milk bags. In some configurations one or more trays are stacked and in some configurations one or more trays are nested. It should be appreciated that the embodiment shown in FIGS. 3 to 10, as well as the other embodiments shown in FIGS. 11 and 12, are intended solely for illustrative purposes, and that the present invention is in no way limited to the particular example embodiments explicitly shown in the drawings and described herein.

Figure 3:
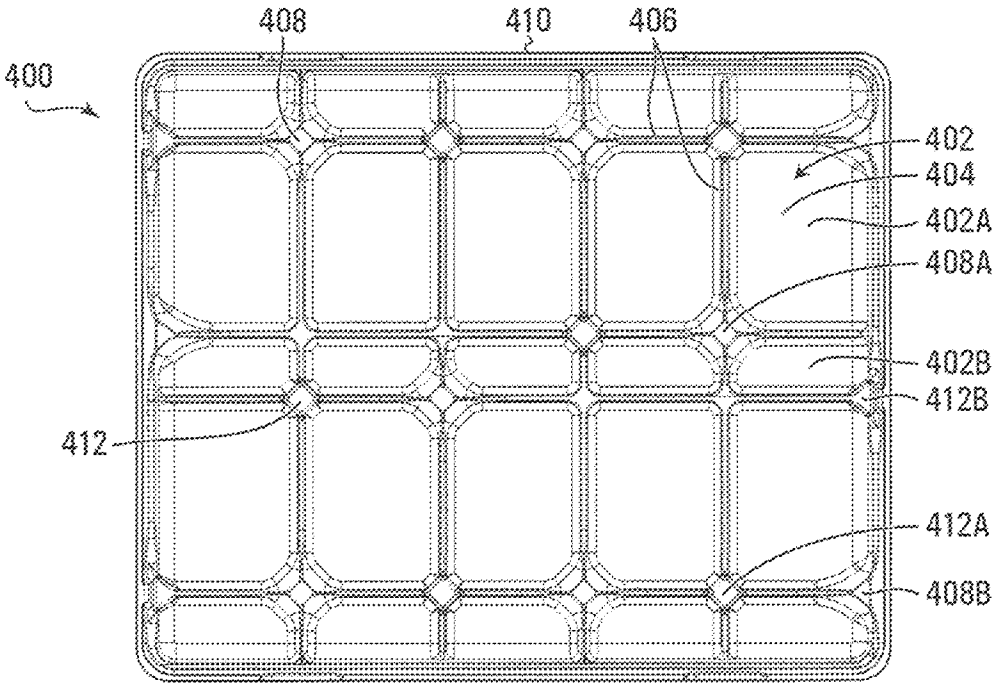
FIG. 3 is a top view of a tray for bags according to a first embodiment.
Figure 5:
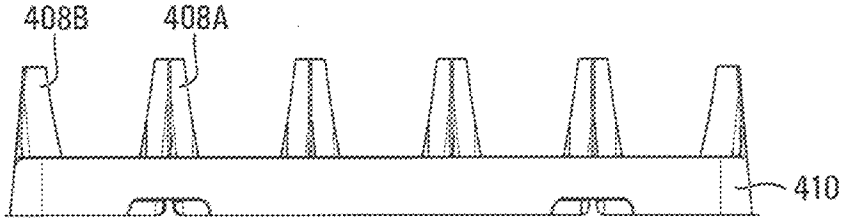
FIG. 5 is a front view of the tray of FIG. 3.
Figure 6:
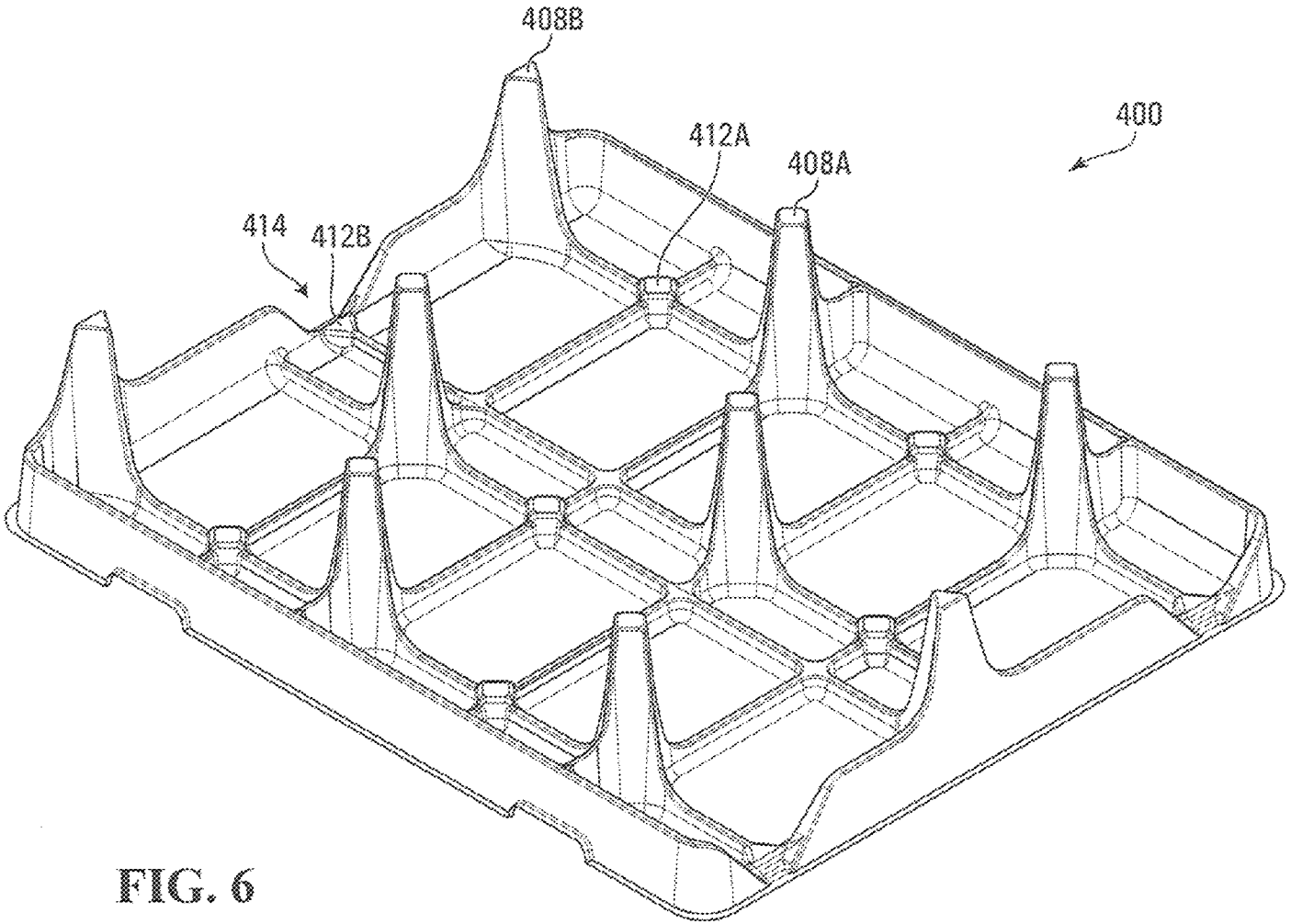
FIG. 6 is a perspective view of the tray of FIG. 3.

Referring to FIG. 3, the tray 400 comprises a tray body comprising a top surface provided with one or more cells 402 for receiving milk bags. The cell 402 may comprise a seat 404 and reinforcement ribs 406 which may surround the seat 404. The cell 402 may be shaped to receive one or more filled milk bags. Though cell 402 is shown as substantially rectangular, this is not essential as other shapes may be employed. The shape employed for cell 402 is usually dictated by the shape and size of the milk bag to be accommodated, so as to effectively use space on the tray 400, while maintaining structural integrity and functionality of the tray 400, as described in further detail below. The milk bags may be rectangular in shape and may be laid flat or may be made to stand up on the seat 404. In one embodiment, the seat 404 may be configured to receive two or more milk bags placed upright. The seat 404 may comprise a flat surface. In some other embodiments the seat 404 may be contoured and not flat.

Stability can be enhanced where the cells have a shape that is complementary to a shape of the bags which can contribute to not only lateral stability, but also to axial stability in keeping bags aligned in a vertical or axial direction. Maintaining bags in an upright position, in addition to constraining them from lateral movement, further improves stability of a stacked arrangement.

Reinforcement ribs 406 may surround the seat 404 and may be shaped and sized to provide rigidity and stability to the tray 400. The reinforcement ribs 408 may also provide structural, mechanical and functional support to the tray 400 to prevent the tray 400 from warping or buckling when the trays are stacked, as discussed in further detail below.

The tray 400 may also comprise a side wall 410. Side wall 410 may extend along the entire perimeter of the tray 400. The side wall 410 may provide stability and may aid in preventing the milk bags from failing over and/or off the tray 400. As shown in the embodiment of FIG. 3, if a plurality of cells 402 is provided, the cells 402 which are located at the outer edge of the tray are defined along at least a portion of one of their sides by the side wall 410. The side wall 410 and/or the ribs 406 may provide support so that the milk bags received in cells 402 may stand upright.

One or more milk bags may rest on the seat 404 and may be able to stand upright with the aid of the ribs 408, the side wall 410 and/or other surrounding milk bags. Side wall 410, and/or ribs 406 may also provide support, against lateral shifting of the milk bags. Side wall 410 and/or ribs 406 may prevent the spread of spilled product, i.e. milk or other liquids, throughout the trays 400 or the stacked arrangement of trays 400. Side wall 410 and/or ribs 408 may provide rigid support horizontally across the tray 400 and/or perpendicular or parallel to the side walls 410 allowing for clamp truck manipulation.

As shown in the embodiment of FIG. 3, more than one cell 402 may be provided. Specifically, the top surface of tray 400 may comprise two or more cells 402 which could be substantially the same or differ at least in size. For example, tray 400 may be provided with an array of cells 402A which differ in size from cells 402B. In the example embodiment shown in FIG. 3, the maximum number of milk bags that may be received in cell 402A is three and the maximum number of milk bags that may be received in cell 4026 is one, although the maximum number of milk bags which may be accommodated depends on the shape and size of cells 402A and 402B, and the shape and size of the milk bags being used. The number, size and/or shape of cells 402 is not limited to the array shown in FIG. 3 and a different number, size and shape of cells 402 may be used to accommodate a desired number, size and/or shape of milk bags.

The tray 400 may also comprise one or more support columns 408. Support columns 408 may be integral with ribs 408 and/or seat 404 or may be separable from the tray 400 altogether so that the tray 400 and the support columns 408 can be releasably connected. If not formed integrally with tray 400, the support columns 408 may be made of a material different than the tray 400 and/or may be made of a corrugated material, a metal or a combination of one or more polymers and one or more metals. Support columns 408 may be tapered to be narrower at the top than at the base and/or have varying cross-sections or shapes in order to provide a better fit when the tray 400 is stacked or nested. The number, placement and orientation of support columns 403 may vary.

Support columns 408 may be hollow to permit nesting of the tray with another tray immediately above or immediately below. Support columns 408 may also provide support against lateral shifting of the milk bags.

As shown in the embodiment of FIGS. 3 to 8, support columns 408 may be formed integrally with tray 400. In one embodiment where the tray 400 is provided with more than one support column 408, the tray 400 may be provided with support columns of different height, size, cross-section and/or shape. For example, as shown in FIGS. 3 to 6, the tray 400 may be provided with support columns 408A which differ in height, shape and cross-section from support columns 408B. Support columns 408A may be integrally formed with ribs 408, while support columns 408B may be integral with ribs 408 and side wall 410. In one embodiment support columns 408A may be formed at one or more intersections of ribs 408 and support columns 408B may be formed at one or more intersections of ribs 406 and side wall 410. Support columns may be arranged at the perimeter of tray 400 and/or in the interior of tray 400.

Depending on the implementation, the number of ribs 408 and/or support columns 408A and 408B may be varied. As seen in FIGS. 3 to 6, it may be possible to arrange six support columns 408A and three support columns 408B on the tray 400. The arrangement and/or number of support columns 408 may be based on a variety of factors including, but not limited to: the amount of material available to manufacture the tray 400, the desired orientation, location and/or number of milk bags arranged on the tray 400, the desired stability and/or height of the trays 400 when stacked, and/or the desired configuration for the trays to nest when empty.

In addition, if is possible to vary the orientation and/or location of the ribs 406. The combination of a desired number, location and/or orientation of the ribs 408 and/or support columns 408 results in a desired number, shape and size of the cells 402 and corresponding seats 404.

The top surface of tray 400 may also comprise one or more protrusions 412. Protrusions 412 may be formed integral with ribs 408 and/or side wall 410. Protrusions 412 may cooperate with ribs 406 to provide structural, mechanical and functional support to the tray 400. Protrusions 412 may also aid in supporting milk bags to stand up-right. Protrusions 412 may have different size, shape and/or cross-sections. For instance, as shown in the embodiment of FIGS. 3 to 6, protrusions 412A and 412B may vary in size and cross-section.

The side wall 410 may comprise one or more recesses 414 and/or may have a corresponding protrusion 412B immediately adjacent each recess 414. This may improve the structural integrity and load-carrying capacity when the trays 400 are stacked.

Figure 7:
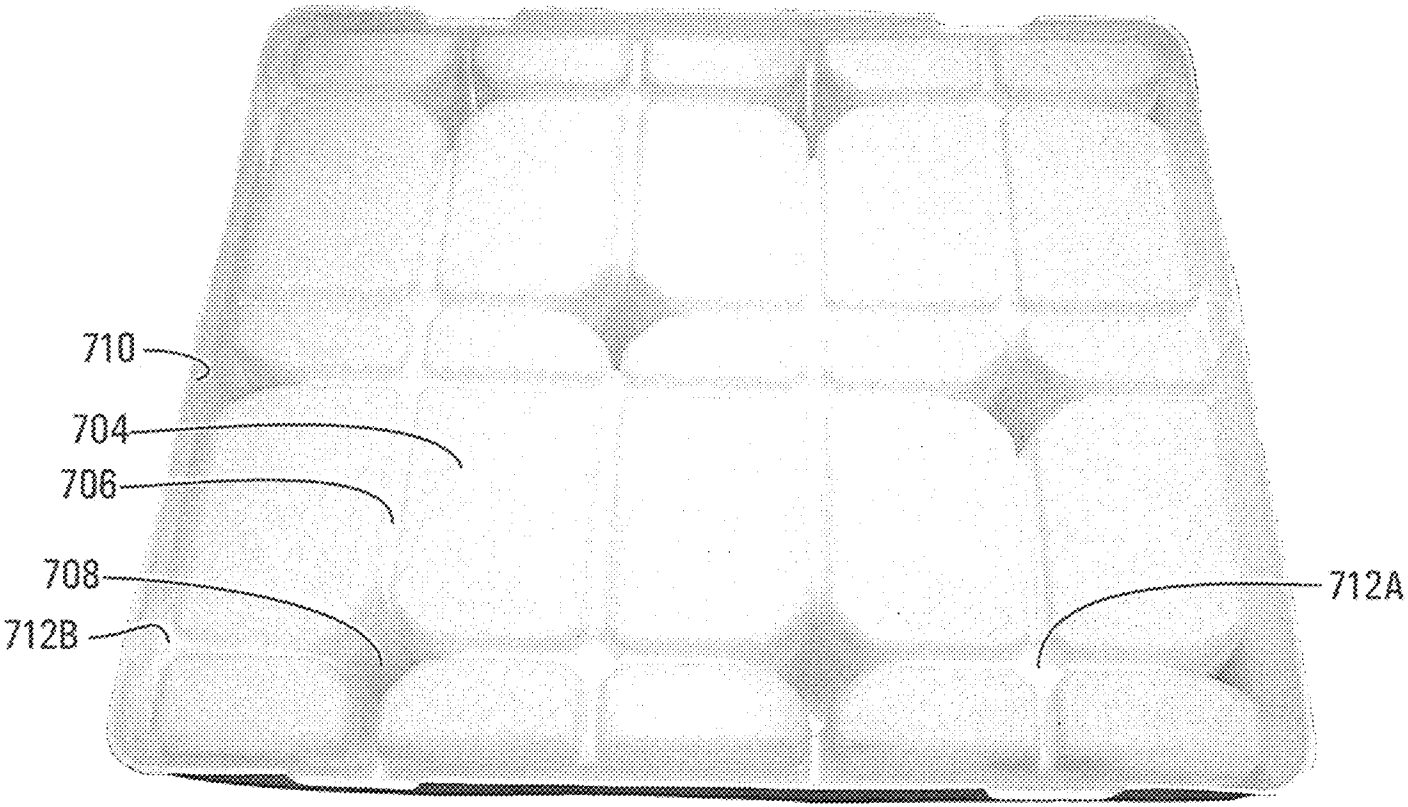
FIG. 7 is a photograph of an underside of the tray of FIG. 3.

As shown in FIG. 7, the tray body of tray 400 comprises bottom surfaces 704, rib grooves 706, recesses 708, side wall groove 710 and/or support column pockets 712A and 712B.

The tray 400 may be created from a single unit of suitable material (such as plastic). More specifically, the tray 400 may be made by a variety of methods, for instance thermoforming, injection molding, compression molding or rotational molding, among others. The tray 400 may be made out of any suitable material, for example, polymers such as high-density polyethylene, high-molecular weight polyethylene, polystyrene, metals such as aluminum or steel, composite materials such as polymers combined with cellulose (paper) or other fibers, other suitable composites, or a combination of a polymer and a metal. The tray 400 may also be made of too or more separate pieces that have been releasably or permanently connected or joined by a variety of methods e.g. welding, using fasteners, gluing etc. Similarly, the tray 400 may be reinforced after being manufactured. The tray 400 may be reinforced with a combination of various materials which are suitable for the purpose of reinforcement. In one embodiment, the tray 400 not loaded with milk bags weighs about 6 Kg.

In the case where tray 400 is thermoformed of a single unit of material, the features on the top surface and underside of the tray 400 are mirror or inverse images of each other. Thus, bottom surfaces 704 are the underside of seats 404, rib grooves 706 are the underside of ribs 406, recesses 708 are formed in the inferior of support columns 408, side wall groove 710 is the underside of side wall 410 and support columns pockets 712 are the underside of protrusions 412.

Recessed pockets 712A and 712B may be formed integral with the grooves 708. When tray 400 is stacked with another tray of similar construction, support columns 408 of one tray 400 are inserted into corresponding pockets 712 of another tray 400. The pockets 712A and 712B may be contoured, shaped or configured to receive the top portion of support columns 408 of another tray 400 when trays 400 are stacked.

Rib grooves 708 may provide structural, mechanical and functional support to the bottom surface of the tray 400 to prevent the tray 400 from warping or buckling.

Some of the pockets 712A may be of different depth, shape, size and/or cross-section than other pockets 712B in order to accommodate corresponding support columns 408A and 408B of different heights, shape, size and/or cross-section. Pockets 712A which are not integral with the side wall groove 710 may be more or less deep than other pockets 712B of the tray 400. As shown in FIGS. 3 to 8, the support columns 408B may have a triangular cross-section which is different from the generally rectangular cross-section of support columns 408A. Thus, corresponding pockets 712B may also have a triangular cross-section.

When the trays 400 are stacked (see FIG. 8), the pockets 712 receive the support columns 408 from the tray 400 underneath in an interference fit and/or a positive fit (friction type locking feature). This may aid in securing the support columns 408 into place and may provide support column alignment, lateral support and/or stacking strength, when the trays are stacked.

Engagement between support columns 408 of tray 400 and pockets 712 of another tray 400 may be aided by a shallower portion of side wall groove 710, which corresponds to the underside of recess 414. Thus, the pocket 712B and/or the recess 414 may aid in aligning support columns 408B into the under side of the recess 414, preventing receipt by the side wall groove 710. Furthermore, these features in conjunction may also allow the support columns 408B to be guided into pockets 712B to improve stacking ability and reduce warping or deformation of support columns 408B.

In one example embodiment, the support columns 408B which are formed integral with the side wall 410 may be 9.5 inches tall while the support columns 408A arranged on the interior of the tray may be 10.0 inches tall. Corresponding pockets 712B and 712A may also be half an inch difference in height in order to accommodate the difference in height of support columns 408A and 408B, respectively. The tray 400 may hold 45 milk bags in total and the tray 400 may be 48 inches long and 40 inches wide, with the side wall 410 having a maximum height of 3.75 inches. Some embodiments of the invention are intended to receive milk bags of the type ordinarily sold in Canada. In Canada a milk bag is approximately 11 inches long by 11 inches tall by 4 inches wide and contains three smaller 133 L milk bags inside. In this configuration, the tray 400 may hold a maximum of 45 milk bags of the type ordinarily sold in Canada.

Milk bags and one or more trays could be stacked to form a stacked arrangement, with one or more milk bags on the top surface of a tray and multiple milk bags below the bottom surface of the tray. The stacked arrangement could be sized, for example, to fit on a standard pallet and/or for display in a retail setting according to retailer specifications. A stacked arrangement could include two or more layers, with a respective tray between each pair of adjacent layers.

Referring now to FIG. 3, a stacked arrangement 800 of trays for milk bags may be provided. Using at least two trays 400 it may be possible to create a stacked arrangement of loaded trays i.e. where a first cell 402 of a first tray 400 receives one or more milk bags filled with a liquid, such as milk. Typically, but not necessarily, all cells 402 would first be filled with milk bags before a second tray 400 is then placed on top of the milk bags such that the milk bags may be engaged and may be partially compressed by the bottom surface(s) 704 of the underside of the second tray 400. The cells 402 of the second tray 400 may then receive one or more filled milk bags. The weight of the milk bags on the second tray 400 may be supported by the second tray 400 which is in turn at least partially supported by the milk bags of the first tray 400. Thus, as one progresses down the stack, each milk bag in each layer carries a portion of the load of the milk bags vertically above it.

When the trays 400 are loaded with milk bags and stacked, bottom surfaces 704 may engage the top of the milk bags and transfer a portion of the load onto the milk bags, thereby partially compressing the milk bags. As such, the milk bags can be used as "self-supporting" containers, i.e. capable of bearing at least some load in the vertical direction. By distributing a portion of the load of the stacked arrangement onto the milk bags being stacked, it is possible to reduce or substantially eliminate the head space between each layer of milk bags and the tray 400 above.

Figure 8:
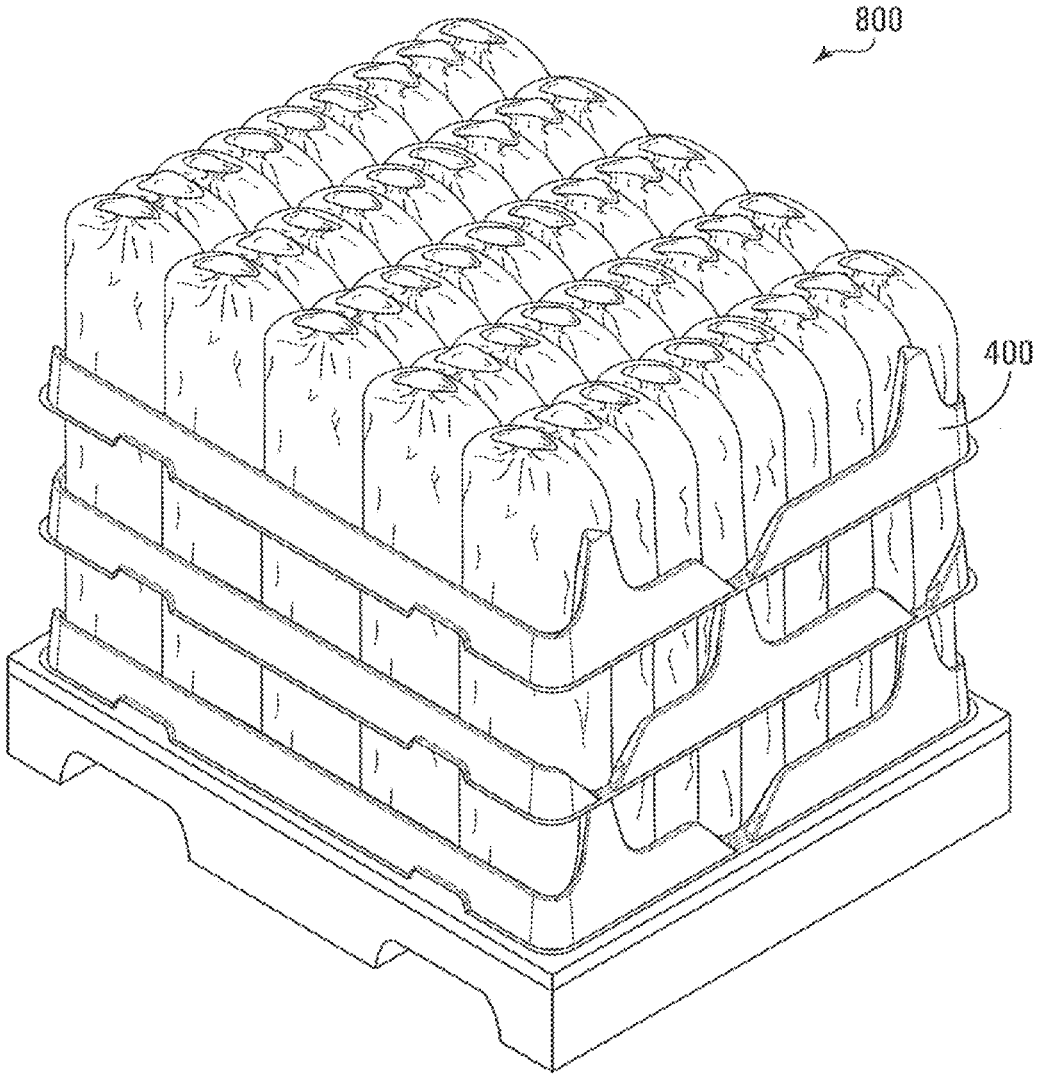
FIG. 8 is a perspective view of a stacked arrangement according to an embodiment when loaded with bags.

Thus, in the embodiment shown in FIG. 8, when the trays 400 are loaded and stacked the head space between each layer of milk bags and the tray 400 above them may be reduced until the milk bags are at least partially compressed, which may result in a saving of the overall capacity of shipping, storage and display space. Thus, in this one particular embodiment, the milk bags are themselves employed to support at least a portion of the load of the trays 400 above, because they have been found to be capable of doing so.

In such a manner a stacked arrangement with a desired number of milk bags and trays 400 may be assembled. The height of the stacked arrangement 800 may be limited by the load carrying capability of the milk bags being used and/or by the stability of the stacked arrangement 800. As additional trays are loaded and stacked the load exerted onto the lowest layer of milk bags may increase. The load carried by the milk bags at each layer may decrease higher up in the stacked arrangement 800. Depending on the implementation and the shape, number, size and type of milk bags used, this load bearing capacity may present a limit to the number of milk bags that may be stacked using trays 400.

In one particular embodiment of the stacked arrangement 800, the stacked arrangement 800 might comprise three layers of milk bags, each layer comprising 48 milk bags.

Varying the depth of pockets 712 and/or the height of support columns 408 allows the amount of vertical distance between two trays to be varied when stacked. In such a manner, it is possible to adjust the amount of compression being applied to the milk bags ranging from all load to no load. Thus, depending on the implementation, it may be possible to adjust the depth of pockets 712 and/or height of support columns 408 to reduce even further the vertical distance between the trays 400, and consequently increase overall space savings, while at the same time not exceeding the milk bags' load carrying capability.

Figure 2:
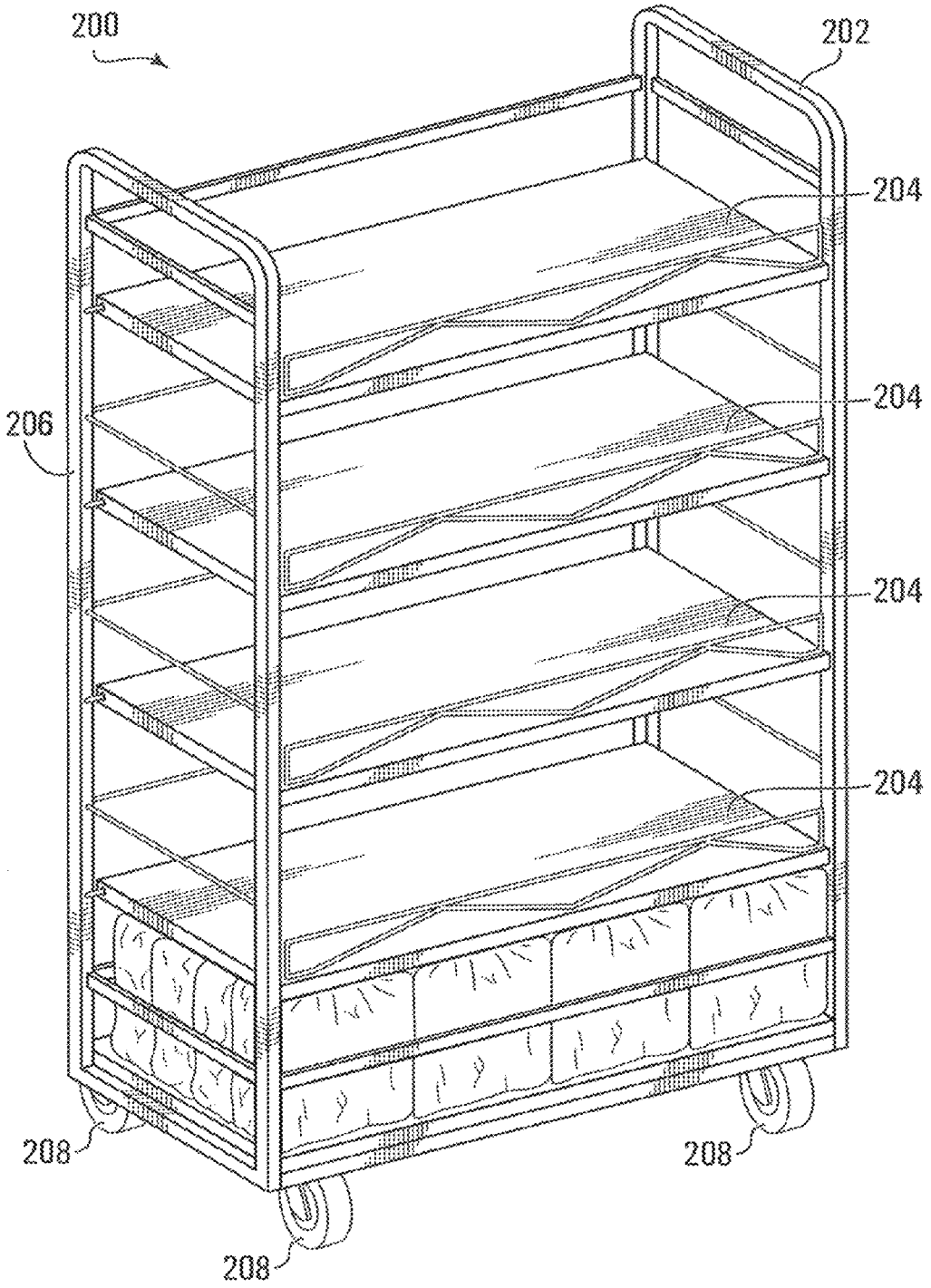
FIG. 2 Prior Art
FIG. 2 is a perspective view of a conventional milk bag shelving unit.
Figure 4:
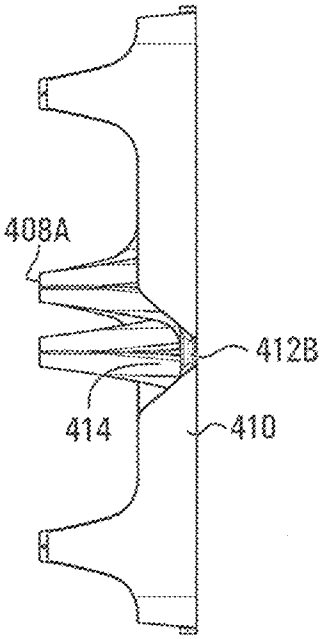
FIG. 4 is a side view of the tray of FIG. 3.

As compared to the milk crates and shelving units such as those illustrated in FIGS. 1 and 2, when trays 400 are stacked, the stacked arrangement 800 may provide for one or more of the following advantages: (i) less room being required to transport, hold and display a stack, of milk bags; (ii) a utilization of the load carrying capacity of the milk bags; (iii) there may be cost savings passed on to consumers as shipping and handling costs would be less, and less room may be taken up in a retailer's display case; (iv) the trays may be reusable and/or recyclable; (v) the trays may take up less room when empty as compared to prior art crates or shelving units required for the same amount of milk bags. When compared specifically to the shelving unit 200 of FIG. 2, the tray 400 may be safer, because there are no movable metal shelves.

Features of illustrative embodiments are described in detail above and shown in FIGS. 1 to 8. Variations on these illustrative embodiments are expected.

For instance, in another embodiment, depending on the load carrying capacity of the milk bags being used and/or the amount of milk bags being stacked, the entire load of a stacked arrangement may be supported by the milk bags themselves.

In yet another embodiment, the load might not be transferred onto the milk bags of the first tray 400 and the entire weight of the milk bags of the second tray 400 might be supported by the support columns 408 of the first tray.

In some embodiments, the trays may contain holes to allow for drainage of liquids used to wash the trays if they get dirty. In yet other embodiments, the trays may contain holes, handles or notches cut into side walls of the trays to allow for picking up and handling. In still further embodiments, different trays may have different colours or be formed with embossments or other features to identify or label the trays, and in particular, to indicate what product is being held on the tray. For instance, a tray may be the same colour as the labeling of the milk bags being contained in the tray. This colour may also or instead indicate the type of milk being sold, for instance, red for homogenized milk, blue for 2% milk and white for skim milk. The trays may also be produced by a variety of manufacturing methods in addition to or instead of those already disclosed. In one embodiment, the trays may be made of cross-hatched plastic similar to plastic milk crates. This may save on material and/or costs.

In yet other embodiments, the trays may include features to assist a clamp truck and/or robotic means in picking up and moving the empty stack of nesting trays or the loaded stacked arrangement. The trays may also be used multiple times and re-loaded at a production facility. In such a case, the trays may include features for improved cleaning of the trays e.g. smooth surfaces, sufficiently large radii at corners and edges to allow the trays to be cleaned, features for self draining in a vertical orientation, features for conveying through a washing machine etc. The trays may also include coatings for improved moisture resistance, anti-microbial coatings and/or materials.

Reference has been made in this specification to milk bags typically sold in Canada. Other countries employ other size milk bags, and the configuration of tray 400 (i.e. location & number of support columns and size & number of cells, etc.) could be different to accommodate these different size milk bags. For instance, the embodiments shown in FIGS. 11 and 12 show different shapes, sizes, and configurations of cells 402, seats 404, ribs 408, support columns 408, side wall 410 and protrusions 412. Thus, what has been described is merely illustrative of the application of the principles of the present disclosure. Other arrangements can be implemented by those skilled in the art.

One or more such stacked arrangements may be assembled at a milk production or distribution location. The one or more stacked arrangements may be wrapped with plastic wrap and/or corner supports to provide stability during shipping. The stacked arrangement may be placed on a pallet and then loaded onto a truck or other vehicle using a forklift, clamp truck or other means. Alternatively, the stacked arrangements may be assembled, shipped, and/or displayed without a pallet. In one embodiment, the dimensions of the tray 400 fit onto a pallet ordinarily used in the shipping industry. The tray 400 may occupy any fraction of a pallet e.g. one half, one fourth, one third etc. The stacked arrangement may also be transported, shipped, displayed and packaged with means other than pallets, for example, a flat bed cart with wheels.

In one particular embodiment, the stacked arrangement may comprise three trays 400, each fully loaded with 45 filled milk bags. In this embodiment, the weight of three trays fully loaded with 45 milk bags each would be about 1200 lbs.

One or more such stacked arrangements may then be shipped to a retail or wholesale location. At the retail or wholesale location, using a forklift, clamp truck or other means, the stacked arrangement may then be placed in a position to provide access to customers. Customers may then take milk bags as necessary from the uppermost tray 400. When the tray 400 is empty, the tray 400 may be removed, exposing the milk bags resting on the tray 400 beneath. In such a manner, it may be possible to vend liquid-filled milk bags to customers without the need for manual or other kinds of labour to transfer the milk bags from the means used for shipping the milk bags to other means used for displaying and selling the milk bags. The sale of milk bags using such one or more stacked arrangements may be considered more esthetically pleasing to consumers as compared to prior art milk crates and shelving units.

Figure 9:
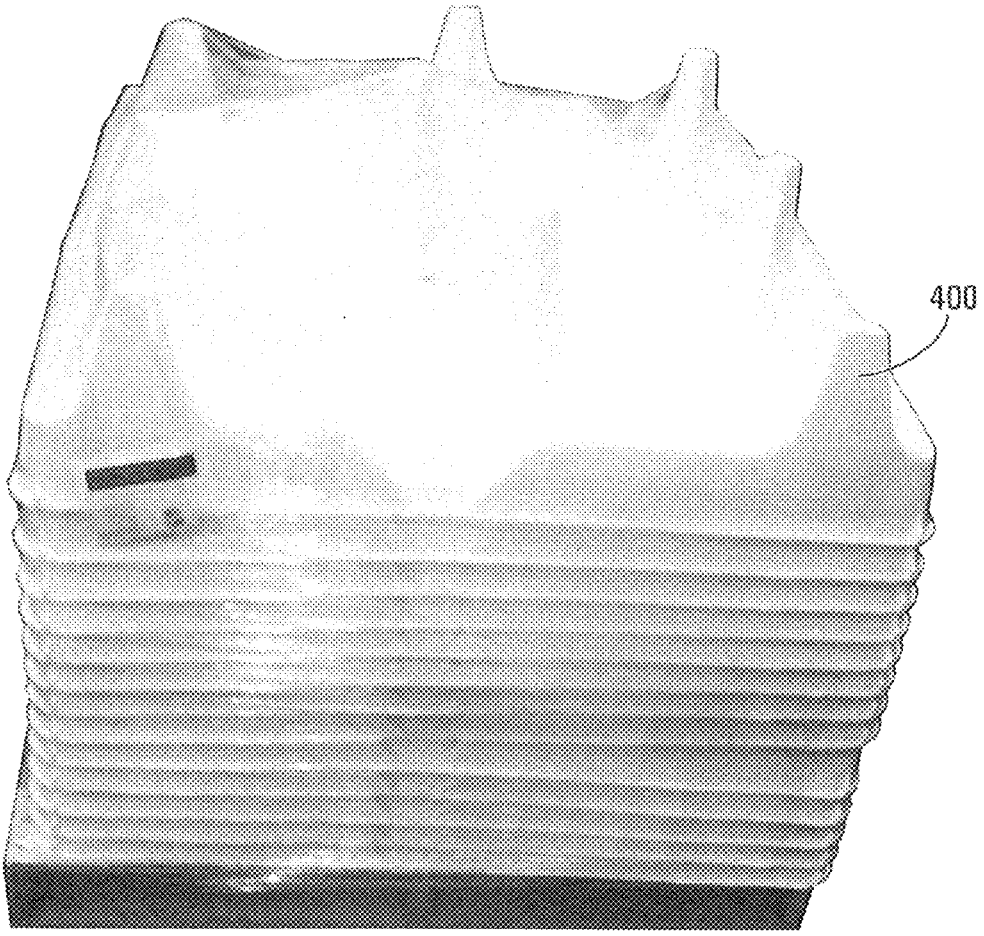
FIG. 9 is a photograph of a perspective view of a stack of empty, nesting stacking trays of FIG. 3.

As shown in FIG. 9, in a first configuration, trays 400 may nest when empty. In this first configuration, all trays 400 are oriented in the same direction. When the trays 400 nest, support columns 408 of a lower tray line up with and are received by the recesses 708, which may be formed in the interior of the support columns 408 of the tray above. Similarly, when trays 400 nest, ribs 406, side wall 410 and/or protrusions 412, if present, may be received by the rib grooves 706, side wall groove 710 and/or pockets 712 of the upper tray 400, respectively.

Figure 10:
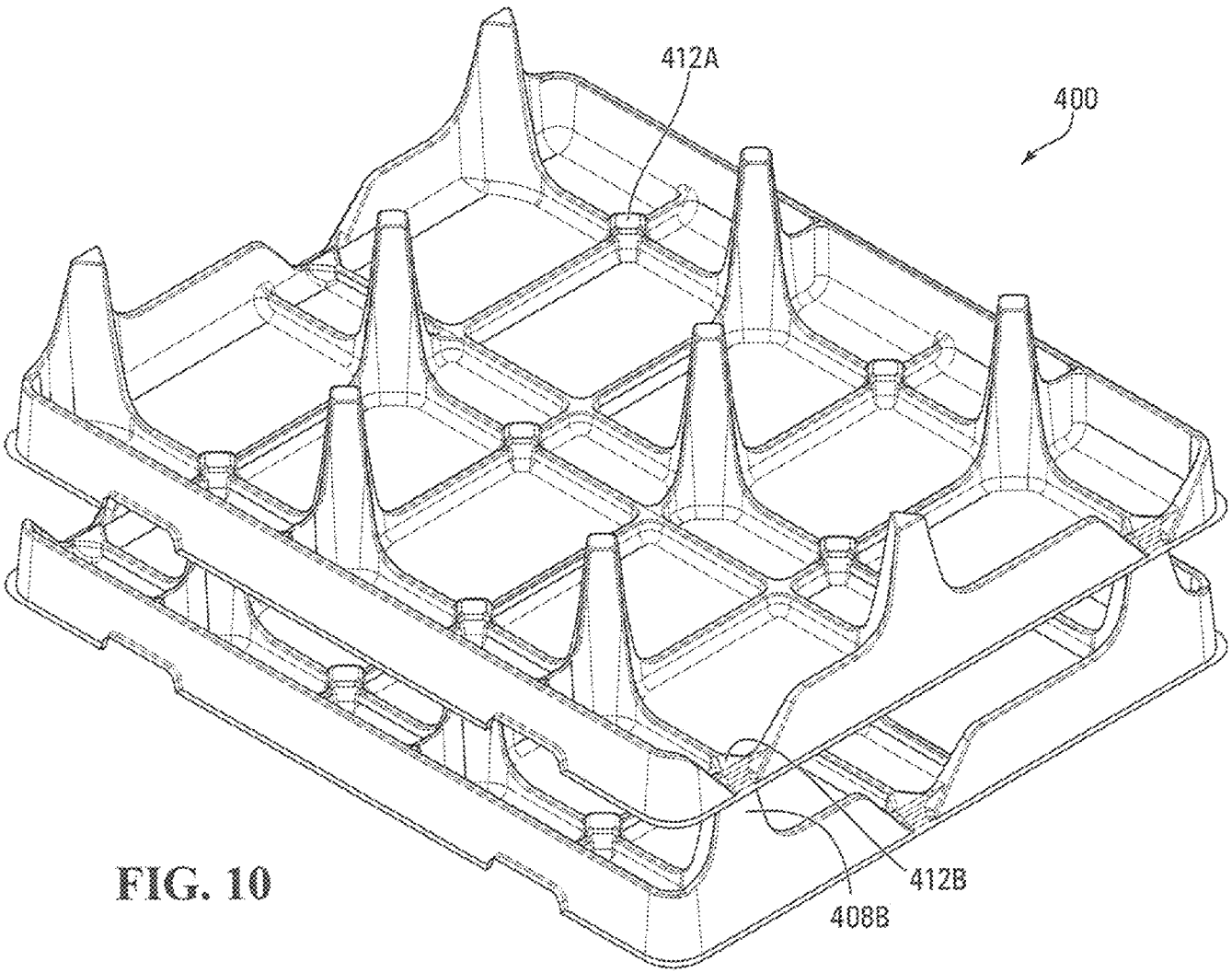
FIG. 10 is a perspective view of a stacked arrangement of the tray of FIG. 3 when not loaded with bags.
Figures 11, 12:
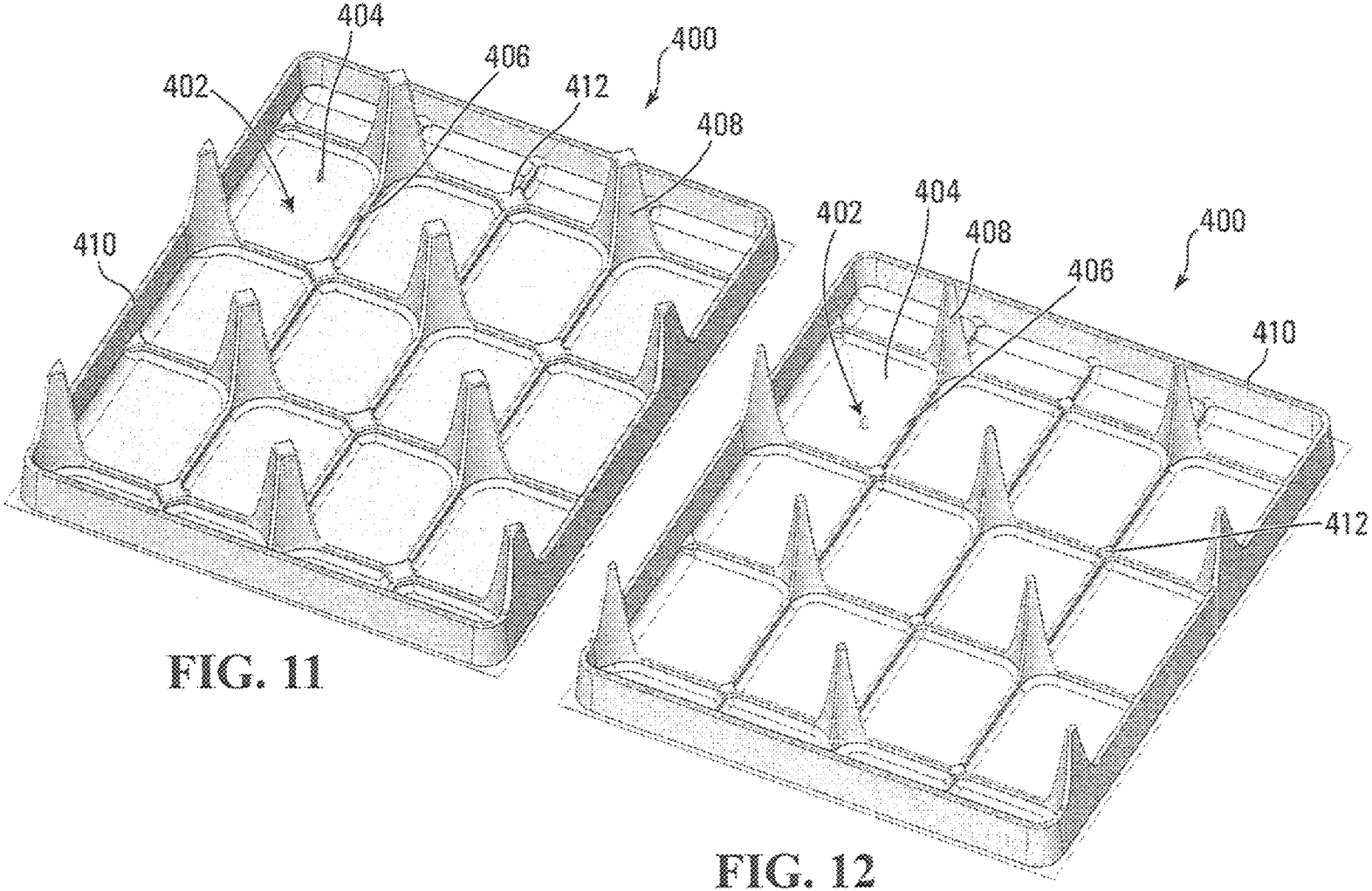
FIG. 11 is a perspective view of a tray for bags according to a second embodiment.
FIG. 12 is a perspective view of a tray for bags according to a third embodiment.

As shown in FIG. 10, in a second configuration, trays 400 may stack. In this second configuration support columns 408 of the lower tray line up with and are received by the pockets 712 of the upper tray. Thus, in the second configuration an upper tray 400 rests on the support columns 408 of a lower tray.

In one embodiment, the support columns 408 and pockets 712 may be arranged so that in the second configuration, the first tray is rotated 180 degrees with respect to the second tray about an axis perpendicular to the top surface of tray 400.

If more than two trays 400 are stacked in this manner, every second tray 400 is rotated 180 degrees with respect to the trays 400 above and beneath it.

In order for the first and second configurations to be 180 degrees apart, support columns 408 and pockets 712 are arranged on the tray so that the tray 400 may be symmetrical with respect to either the axis bisecting its length or the axis bisecting its width.

Thus it may be possible to nest the trays 400 so they take up less vertical space than a stacked arrangement loaded with milk bags. This space savings may yield storage and transportation savings, and may make it more likely that retailers will return the nested trays to the milk producer or distributor for reuse.

Embodiments are described above primarily in the context of trays and stacked arrangements of trays and milk bags. Other embodiments, in the form of methods for instance, are also possible.

Figure 13:
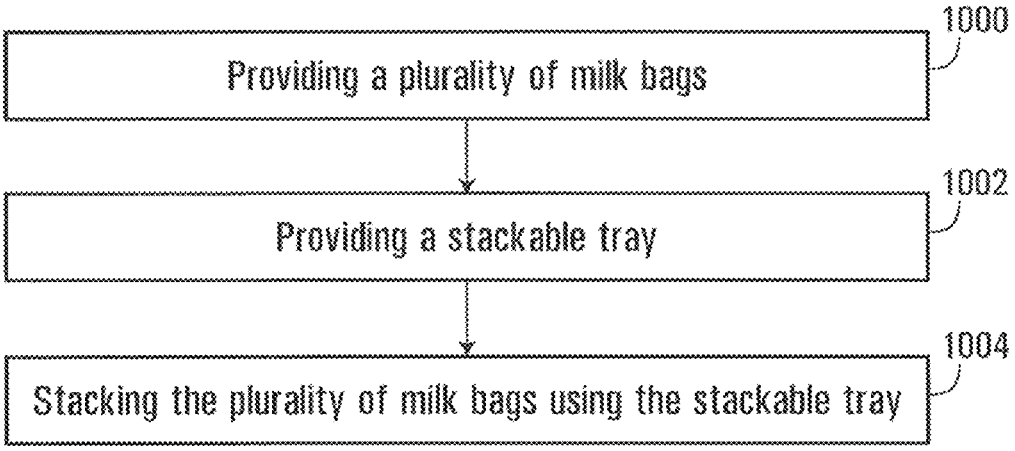
FIG. 13 is a flow-chart illustrating an example method.

FIG. 13 is illustrative of an example method. Variations are possible. According to the example method, at 1000 a plurality of milk bags is provided. At 1002, a stackable tray is provided. The stackable tray may be a tray as shown in the embodiments in FIGS. 1 to 8 or otherwise disclosed herein. At 1004 the plurality of milk bags are stacked in multiple layers using the stackable tray.

If should also be appreciated that the providing at 1000, 1002 need not necessarily involve manufacturing the milk bags and/or the trays. A packaging entity might source the milk bags and/or trays from one or more manufacturers, to thereby "provide" the milk bags and trays at 1000, 1002 for use in the stacking at 1004. A product packer or shipper could purchase or otherwise provide the milk bags and/or trays. "Providing" is not in any way intended to require manufacturing or otherwise making milk bags or trays.

Further steps may include (i) placing the plurality of milk bags in one or more cells, (ii) arranging the position of a first tray 180 degrees relative to a second tray, (iii) stacking one, two or three more additional loaded trays on top of the first tray, and/or (iv) nesting the first tray with the second tray when the trays are empty.

Illustrative embodiments are described above and shown in the drawings. Other variations, modifications and improvements may be possible and are included within the scope of the present disclosure.

What is claimed is:

1. A stacked arrangement comprising:

a first tray comprising:

a first surface for supporting one or more substantially identical compressible bladders containing liquid, wherein each of said bladders has a resting height, one or more columns extending from said first surface, and a second surface, opposite said first surface, said second surface comprising one or more recesses;

said one or more bladders containing liquid arranged on said first tray; and an identical, second tray stacked on said first tray, wherein the one or more recesses of said second tray receive ends of said one or more columns of said first tray, wherein a vertical distance between said first surface of said first tray and the second surface of said second tray is less than said resting height, and wherein the second tray is supported at least partially by said one or more bladders on said first tray and at least partially by said one or more columns of said first tray, said one or more bladders being at least partially compressed between said first surface of said first tray and said second surface of said second tray.

2. The stacked arrangement of claim 1, wherein said first surface comprises a plurality of cells adapted to receive said one or more bladders containing liquid.

3. The stacked arrangement of claim 2, wherein said second surface is substantially flat opposite each of said plurality of cells.

4. The stacked arrangement of claim 1, said first surface comprising one or more reinforcement ribs to strengthen said first surface.

5. The stacked arrangement of claim 4, wherein said first surface comprises cells of varying or substantially similar shape defined by said one or more reinforcement ribs.

6. The stacked arrangement of claim 5, wherein said cells are each shaped to receive three bladders containing liquid.

7. The stacked arrangement of claim 5, wherein said cells are each shaped to receive one bladder containing liquid.

8. The stacked arrangement of claim 1, said second surface comprising channels to strengthen said second surface.

9. The stacked arrangement of claim 1, wherein said one or more columns are arranged at intersections of two or more reinforcement ribs formed on said first surface.

10. The stacked arrangement of claim 1, wherein said one or more columns each comprise a top and a base and are tapered, being narrower at said top than at said base.

11. The stacked arrangement of claim 1, wherein said one or more columns of said first tray are releasably connectable to the one or more recesses of said second tray.

12. The stacked arrangement of claim 1, wherein said one or more columns are integral with a side wall extending along a periphery of said first surface.

13. The stacked arrangement of claim 1, wherein said first surface comprises two or more columns of varying height, and said second surface comprises two or more recesses of varying depth.

14. A method comprising:

providing a tray for storing a plurality of substantially identical compressible bladders containing liquid, wherein each of said bladders has a resting height, said tray comprising:

a first surface for supporting one or more of said bladders containing liquid;

one or more columns extending from said first surface; and a second surface, opposite said first surface, the second surface comprising one or more recesses for receiving ends of the one or more columns of an identical tray to permit said identical tray to be stacked on said tray, wherein, in stacked arrangement, a vertical distance between said first surface of said tray and said second surface of said identical tray is less than said resting height and said identical tray is supported at least partially by said one or more bladders on said tray and at least partially by said one or more columns of said tray;

providing a plurality of bladders containing liquid; and stacking the plurality of bladders containing liquid in multiple layers using said tray, said one or more bladders being at least partially compressed between said first surface of said tray and said second surface of said identical tray.

* * * * *